United States Patent [19]

Green et al.

[11] Patent Number: 4,776,950

[45] Date of Patent: Oct. 11, 1988

[54] CLASSIFIER

[75] Inventors: Colin A. Green, Heanor; Michael C. Welbourne, Derby, both of United Kingdom

[73] Assignee: Northern Engineering Industries plc, Newcastle upon Tyne, England

[21] Appl. No.: 942,945

[22] Filed: Dec. 17, 1986

Related U.S. Application Data

[63] Continuation of Ser. No. 688,847, Jan. 4, 1985, abandoned.

[30] Foreign Application Priority Data

Jan. 14, 1984 [GB] United Kingdom ..... 8401009

[51] Int. Cl.[4] ..... B07B 7/08; B04C 9/00

[52] U.S. Cl. ..... 209/144; 209/149; 55/400; 55/404; 55/438; 55/398

[58] Field of Search ..... 209/144, 143, 210, 211, 209/149; 210/512.3; 55/397, 398, 400, 408, 401, 405, 406, 409, 317, 438; 241/79.1

[56] References Cited

U.S. PATENT DOCUMENTS

| | | | |
|---|---|---|---|
| 1,505,742 | 8/1924 | Stebbins | 209/144 |
| 1,689,104 | 9/1928 | Bennett | 55/397 X |
| 1,922,299 | 8/1933 | Juengling et al. | 55/398 |
| 2,026,833 | 1/1936 | Holland-Letz | 209/144 |
| 2,290,664 | 7/1942 | Allardice | 55/398 |
| 2,361,758 | 9/1944 | De Fligue | 209/144 |
| 2,367,906 | 1/1945 | Wall et al. | 55/400 X |
| 2,790,508 | 4/1957 | Allander | 55/345 |
| 2,815,860 | 12/1957 | Krantz | 209/20 |
| 2,846,151 | 8/1958 | Wehn et al. | 209/144 X |
| 3,168,466 | 2/1965 | Milne | 209/459 X |
| 3,767,045 | 9/1973 | Voelskow | 209/144 |
| 4,313,910 | 2/1982 | Dries et al. | 209/144 X |
| 4,390,419 | 6/1983 | Burthelmess | 209/144 X |

FOREIGN PATENT DOCUMENTS

| | | | |
|---|---|---|---|
| 751473 | 7/1953 | Fed. Rep. of Germany | 209/144 |

*Primary Examiner*—Kenneth M. Schor
*Assistant Examiner*—Thomas M. Lithgow
*Attorney, Agent, or Firm*—Rosen, Dainow & Jacobs

[57] ABSTRACT

A classifier has a rotor, driven by a motor, mounted between two opposed walls of a housing. The housing also has a curved wall which extends between the walls and around the rotor to define therewith an annular zone. A fluid and finer particles outlet opening is provided in one of the walls. The curved wall has an inlet opening for at least fluid and a fluid and coarser particles outlet opening which is registered with the inlet opening of a receptacle from which the coarser particles can be removed. A plate is located immediately upstream of the outlet opening to divert particles adjacent to the curved wall away therefrom. Similar diverting means can be located remote from the plate such as plate or secondary air inlet openings. Baffle rings are provided concentrically with the rotor to restrain particles forced to the outer peripheries of the annular zone from moving inwardly towards the rotor.

13 Claims, 1 Drawing Sheet

CLASSIFIER

This application is a continuation of application Ser. No. 688,847, filed Jan. 4, 1985, now abandoned.

BACKGROUND TO THE INVENTION

The invention relates to classifiers, particularly though not exclusively classifiers applicable to the classification of particulate cement.

Many conventional classifiers have a rotor mounted in a housing which has a relatively large hopper beneath the rotor for collecting the coarser particles of material being classified. Consequently, the overall height of such a classifier is relatively large and the associated support structure and the additional duct work required lead to high capital expenditure.

Classifiers which do not use a hopper are known (for example, see UK Pat. No. 515717). In developing such a classifier, the Applicants found that the efficiency of classification was relatively low owing to relatively large amounts of product-size (i.e. finer) particles leaving the classifier through the outlet opening for coarser particles.

SUMMARY OF THE INVENTION

The object of the invention is to produce a classifier having an improved classification efficiency in which fewer fine-fraction particles leave the classifier through the outlet for the coarse-fraction particles.

This object is achieved by providing a classifier in which the fluidized particles enter on annular classifying zone tangentially, thereby establishing a vortex flow stream in the annular classifying zone, which flow stream generates classifying forces. The rotor speed influences the vortex flow stream so that a different particle cut size is produced at different rotor speeds, this cut size defining the boundary between the fine fraction and the coarse fraction. Diverting means are provided for diverting particles back toward the vortex flow stream, thereby re-subjecting the particles to the classifying forces.

BRIEF DESCRIPTION OF THE DRAWINGS

An air classifier will now be described to illustrate the invention by way of example only with reference to the accompanying drawings, in which.

DESCRIPTION OF THE EMBODIMENT

Figure 1:
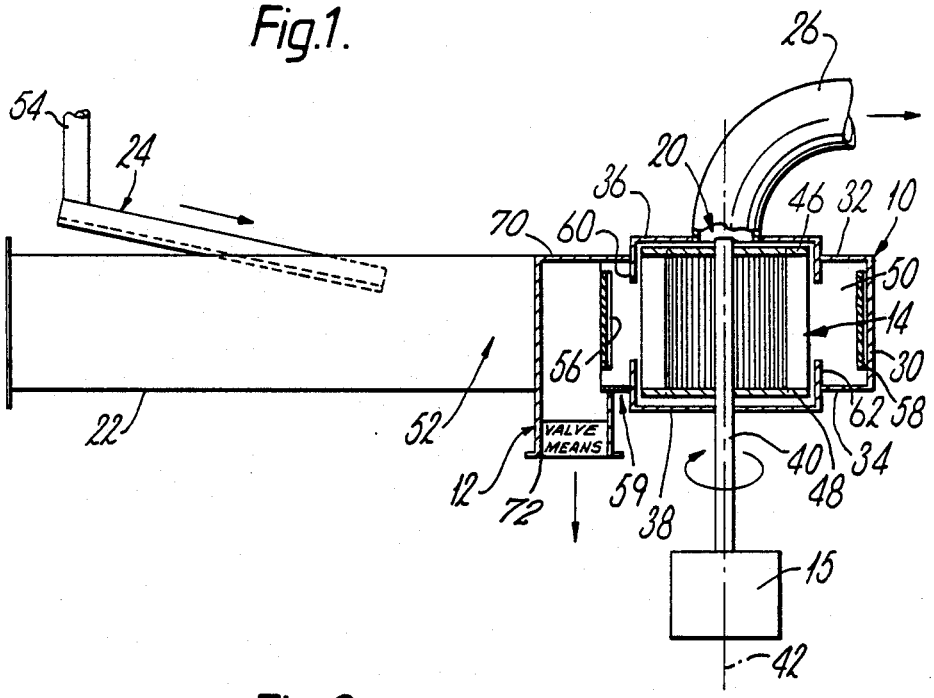
FIG. 1 is a schematic vertical section of the classifier on line I—I in FIG. 2.

The classifier shown in the drawings comprises the following principal parts: a housing 10; a receptacle 12; a rotor 14 in the housing 10; and inlet opening 16 providing an inlet to the housing 10; an outlet opening 18 providing an outlet from the housing 10 leading to the receptacle 12; an outlet opening 20 providing another outlet from the housing 10; a duct 22 leading to the inlet opening 16; a feeder 24 which utilizes particle fluidization leading into the duct 22; and a duct 26 leading away from the outlet opening 20.

The housing 10 is made up of a curved wall 30 and upper and lower opposed walls 32, 34, respectively. The openings 16 and 18 are rectangular openings in the curved wall 30. The opening 18 is immediately upstream, relative to the direction of flow of the vortex flow stream, of the opening 16.

The walls 32 and 34 as shown in FIG. 1 are shaped to form opposed recesses at 36 and 38, respectively, and the opening 20 is a circular opening in the center of the recessed part 36 of the wall 32.

The rotor 14 is mounted on a vertical shaft 40 which is rotatable about an axis 42 concentrically positioned with respect to the recesses at 36 and 38. The rotor 14 is accommodated partly, at its ends, in the recesses at 36 and 28. The rotor 14 comprises an annular array of blades 44 each extending radially with respect to the axis 42, the blades 44 being supported at their ends by upper and lower end members 46 and 48, each consisting of a ring to which the ends of the blades 44 are attached and radially extending arms secured to the shaft 40. A variable speed motor 15 is mounted above the housing 10 and is connected to drive the shaft 40 and the rotor 14 in the sense indicated by the arrows in the drawings.

The rotor 14 and the curved wall 30 together define an annular zone 50 in the housing 10.

Figure 2:
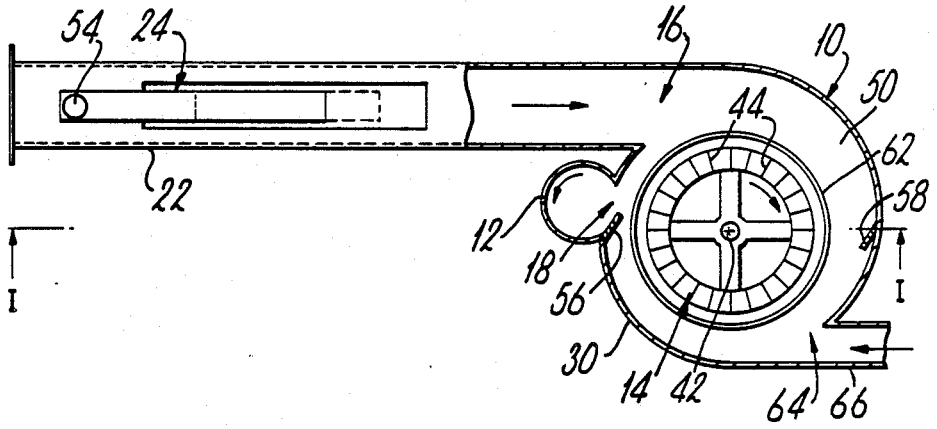
FIG. 2 is a schematic plan of the classifier shown in FIG. 1 with part of the top removed to show internal detail.

The shape of the curved wall 30 is what is known as a scroll. As shown in FIG. 2 the wall 30 is not concentric with the axis 42 but instead the wall 30 approaches the axis 42 as the wall extends away from the radially outer edge of the inlet opening 16 around to the radially inner edge. The clearance between the wall 30 and the rotor 14 accordingly decreases in the same angular sense. The wall 30 makes a smooth continuation of the duct 22, which is of rectangular cross-section to match the opening 16. The air streams from the duct 22 enter the annular zone 50 tangentially to the curved wall 30.

The feeder 24 is mounted in the top of the duct 22 and is inclined downwardly towards the inlet opening 16. The feeder 24 is operable to feed particulate cement into the air stream flowing in the part 52 of the duct 22. Particulate cement is fed downwardly to the feeder 24 through a conduit 54.

The receptacle 12 is an upright hollow cylinder with its central longitudinal axis parallel to the axis 42. The upper end of the receptacle 12 is closed by a flat wall 70 and the lower end has a flange 72 by which the lower end of the receptacle is secured to a closure device (not shown) such as a valve which is normally closed but which is operable to allow particles collected in the receptacle 12 to be removed. The opening into the receptacle 12 is registered with the outlet opening 18 in the curved wall.

The duct 26 is of circular cross-section and is connected to an induction fan (not shown).

The curved wall 30 has a plate 56 positioned immediately upstream, relative to the direction of flow of of the vortex flow stream, of the opening 18. the plate 56 acts to deflect particles on and immediately adjacent to the wall 30 away from the wall 30. The plate 56 is at a slight angle to the wall 30 whereby, as can be clearly seen from the drawing, particles are diverted away from the wall 30 generally tangentially to the middle of the annular zone 50. The plate 56 extends only over a portion of the width of the wall 30 intermediate the edges of the wall 30.

A second plate 58, substantially the same as the plate 56, is located on the curved wall 30 at a position 180° removed from the plate 56.

Mounted concentrically with the rotor 14 on the walls 32, 34 are upper and lower baffle rings 60 and 62, respectively, which extend towards one another. Portions of the lower wall 34 between the curved wall 30 and the baffle ring 62, particularly in the regions close to the opening 18 can be perforated (as shown at 59) whereby air to maintain particle fluidization can be drawn into the annular zone 50 through such portions.

A second inlet 64 in the curved wall 30 is positioned intermediate the plates 56, 58 and is connected to a duct 66 through which secondary air flows tangentially into the annular zone 50.

OPERATION

The rotor 14 is rotated, the induction fan is operated to draw air through the classifier and the feeder 24 is operated to feed cement particles into the duct 22, a vortex flow of air and cement particles being established in the annular zone 50.

The feeder 24 serves to prevent or reduce agglomeration of the particles. Some classification is already occurring in the duct 22 since the fluidization of the particles by the feeder 24 tends to result in the heavier particles falling towards the base of the duct 22 under gravity.

Once the air and particles enter the annular zone 50 classification continues. According to the particle size, the centrifugal and air drag forces to which the particles are subjected will cause larger particles to migrate outwards and finer particles to migrate inwards. The particle size for which the forces are in balance is called the cut size.

The effect of the rotor 14 is to influence the vortex flow and to enable to cut size to be adjusted by varying the rotor speed.

The relatively finer particles move inwardly in the housing 10 with the air flow and pass between the rotor blades 44 towards the outlet opening 20, leave the classifier through the duct 26 and pass to a cement product collection point.

The relatively coarser particles move outwards and ultimately reach the curved wall 30 and are restrained by the wall as they move with the rotating vortex flow. Upon reaching the outlet opening 18 the relatively coarser particles are freed from such restraint and can pass from the housing 10 through the opening 18 into the receptacle 12.

Particles entering the receptacle 12 are constrained by the inner surface of the receptacle 12 to move in a circular path in the sense indicated by the arrow in FIG. 2. The particles entering the receptacle 12 settle downwardly in the receptacle 12 under the effect of gravity and eventually come to rest at the bottom of the receptacle 12 supported by the closed valve mentioned above. From time to time the valve is operated to remove settled particles from the receptacle while the classifier is in operation without adverse effect on its performance.

The vortex flow in the housing 10 induces a rotation of air in the receptacle 12 in the sense indicated by the arrow in FIG. 2.

The plate 56 causes the particles restrained by the curved wall 30 generally tangentially to the middle of the annular zone 50 to be diverted away from the wall 30. That action has the effect of reducing the amount of finer particles which leave the housing 10 through the outlet opening 18. The effect of the plate 56 is believed to be two-fold. Firstly, as the particles restrained by the wall 30 are diverted away from the wall 30 it is only the coarser and, consequently, heavier particles that have the necessary energy to pass through the opening 18. Secondly, as the particles are diverted away from the curved wall 30, any finer particles which may have been trapped by the coarser particles are re-subjected to the classifying forces.

The latter point is also thought to account for a further reduction in the amount of finer particles leaving the housing 10 through the opening 18 which occurs owing to the presence of the plate 58.

A similar effect is obtained owing to the diverting action of the secondary air entering the annular zone 50 through the inlet 64.

The forces involved in classification also result in coarser particles moving to the outer peripheries of the annular zone 50 and then being forced inwardly towards the rotor 14. The baffle rings 60, 62 restrain such inward movement of the particles and the particles tend to spiral in the outer peripheries of the annular zone 50. The plates 56 and 58 extend only over an intermediate portion of the width of the curved wall 30 to ensure that the particles restrained by the baffle rings 60, 62 are removed from the annular zone 50 as soon as possible.

As the effect is enhanced by gravity, the numbers of particles restrained by the lower baffle ring 62 can be sufficiently high to result in de-fluidization of the particles as the air velocity slows down towards the opening 18 in the curved wall 30. The perforated portions 59 of the lower wall 34 ensures that the particles remain fluidized.

A feature of this design is that the air requirements for conveying and classifying the cement particles are relatively low so leading to relatively lower power consumption overall. A further effect is to permit relatively high ratios of cement to air i.e. high cement loading of the air.

The outlet duct 26 may be connected if preferred to a pressure recovery device (not shown) to reduce energy loss.

A forced-draft fan could be connected to the duct 22 instead of or additionally to the induction fan connected to the duct 26.

In modifications (not shown) the wall 30 may be truly cylindrical instead of scroll shaped; the wall 34 may be curved or otherwise shaped to prevent or inhibit migration of relatively coarser particles over the wall towards and through the rotor 14.

More than one outlet opening 18 may be provided which lead either into a common receptacle or into respective receptacles, for example. The opening 20 may be positioned in the wall 34 beneath the rotor 14 instead of above the rotor, with corresponding re-positioning of the duct 26. The blades 44 may be shaped as desired and the indication given in the drawings is purely diagrammatic.

The angle of the plate 56 to the wall 30 can be adjustable or the width of the plate 56 protruding into the annular zone 50 can be adjustable. Similarly, the plate 58 can be adjustable in like manner. The plate 56 or 58 can be replaced by other diverting means, for example blocks, members with curvilinear surfaces or air inlets. When the diverting means is an air inlet, it is effective over the full width of the wall 30 unless it is the diverting means immediately upstream of the opening 18. When the diverting means are solid members more than one secondary air inlet may be provided in the wall 30.

The particles can be fed directly into the annular zone 50 at one or more locations, for example, the duct 22 carrying air only. Alternatively, the duct 22 could be connected directly to a source of dust-laden air from a grinding mill, for example.

The classifier can be oriented with the axis 42 horizontal instead of vertical. In that case the opening 18 would be at the lower side of the housing 10 and the receptacle would extend tangentially downwardly away from the wall 30; or extend downwardly though not tangentially.

The drive shaft 40 may extend only through the lower wall 34 if preferred leaving the outlet duct 26 unobstructed.

The classifier is relatively compact because a relatively large hopper beneath the rotor is unnecessary. The base of the classifier is relatively or completely plain and horizontal and the overall height of the classifier is relatively small so that the mounting of the classifier is quite simple. Furthermore, the arrangement of the classifier in relation to other duct work and to a cement grinding mill is simplified.

What is claimed is:

1. A classifier for classifying particulate material into first and second particle-size fractions constituted by particles predominantly having a size above a predetermined cut size and particles predemonantly having a size below said predetermined cut size, respectively, comprising:

(a) a housing having two opposed walls and a curved wall which extends from one of said opposed walls to the other;

(b) a rotor mounted in said housing between said opposed walls, said curved wall extending around said rotor to define therebetween an annular classifying zone;

(c) duct means defining a tangential inlet opening in said curved wall through which fluid enters tangentially and parallel to said two opposed walls into said annular classifying zone to form a vortex flow stream in said annular classifying zone, thereby generating classifying forces in said annular classifying zone;

(d) said duct means further defining an inlet opening means for receiving particulate material to be classified whereby the duct means conveys said particulate material and said fluid to said annular classifying zone;

(e) an outlet opening in said curved wall in fluid communication with said annular classifying zone through which said first fraction leaves said housing;

(f) a receptacle having an inlet opening registered with said outlet opening for said first fraction in said curved wall;

(g) an outlet opening means in one of said opposed walls through which fluid and particles of said second fraction, having passed into the interior of said rotor, leave said housing; and (h) drive means operable to rotate said rotor to influence said vortex flow stream, said predetermined cut size being determined primarily by the speed at which said rotor is rotated;

(i) wherein said curved wall has first diverting means positioned immediately upstream of said outlet opening for particles of said first fraction, for diverting all those particles which have moved radially outwardly to said curved wall under the influence of said classifying forces, away from said curved wall generally tangentially to the middle of said annular zone, thereby to re-subject those particles to said classifying forces.

2. A classifier according to claim 1, in which said rotor has an axial length substantially not less than the width of said curved wall.

3. A classifier according to claim 1, in which said tangential inlet opening for fluid extends over substantially the whole width of said curved wall.

4. A classifier according to claim 1, in which said outlet opening for particles of said first fraction extends over substantially the whole width of said curved wall.

5. A classifier according to claim 1, in which a second diverting means is provided at a position upstream of said first diverting means.

6. A classifier according to claim 1 or 5, in which said curved wall has at least one further tangential inlet opening means through which a secondary flow of fluid can enter said annular classifying zone.

7. A classifier according to claim 1 or 5, in which said first diverting means comprises a solid member mounted on said curved wall.

8. A classifier according to claim 1 or 5, in which said first diverting means extends over only a portion of the width of said curved wall intermediate the edges of said curved sall said portion being less than substantially the full width of said curved wall.

9. A classifier according to claim 1, in which each of said two opposed walls has a baffle ring mounted thereon coaxial with said rotor and extending towards one another to restrain particles at the outer peripheries of said annular classifying zone moving radially inwardly towards said rotor.

10. A classifier according to claim 1, in which said receptable is of hollow cylindrical shape having its central longitudinal axis substantially parallel to the axis of rotation of said rotor, said receptable being closed but having valve means which are openable to allow particles which have settled in said receptable to be removed therefrom.

11. A classifier according to claim 1, in which, relative to the direction of flow of said vortex flow stream, said outlet opening for said first fraction is located immediately upstream of said inlet opening for fluid.

12. A classifier according to claim 1, wherein said duct means comprises wall means defining a duct which terminates at said tangential inlet opening and through which said fluid is conveyed, said wall means also defining said inlet opening means whereby both said fluid and said particulate material enter said annular classifying zone through said tangential inlet opening.

13. A classifier according to claim 1, further including baffle means having two portions, mounted coaxially with said rotor and each portion disposed adjacent their respective opposed wall and said portions extending towards each other, for restraining particles at the outer periphery of said annular classifying zone and adjacent said one wall from moving radially inwardly towards said rotor.

* * * * *